United States Patent [19]

Liggett

[11] Patent Number: 4,465,008

[45] Date of Patent: Aug. 14, 1984

[54] SAILCRAFT

[76] Inventor: John A. Liggett, P.O. Box 2031, Stuart, Fla. 33495

[21] Appl. No.: 381,036

[22] Filed: May 24, 1982

[51] Int. Cl.[3] ..... B63H 9/06

[52] U.S. Cl. ..... 114/39; 114/102; 114/103; 114/61; 114/292; 1/114 R

[58] Field of Search ..... 114/39, 102, 103, 104, 114/105, 90, 272, 273, 144 R

[56] References Cited

U.S. PATENT DOCUMENTS

| | | | |
|---|---|---|---|
| 1,504,057 | 8/1924 | Koelkebeck | 114/103 |
| 1,681,415 | 8/1928 | Lee | 114/39 |
| 1,846,458 | 2/1932 | Robinson | 114/39 |
| 2,106,432 | 1/1938 | McIntyre | 114/39 |

FOREIGN PATENT DOCUMENTS

| | | | |
|---|---|---|---|
| 345845 | 11/1920 | Fed. Rep. of Germany | 114/103 |

*Primary Examiner*—Trygve M. Blix
*Assistant Examiner*—Patrick W. Young
*Attorney, Agent, or Firm*—Carroll F. Palmer

[57] ABSTRACT

Improved sailcraft have a plurality of rectangular sails of approximately equal size, each carried on a separate mast that is enveloped by the sail luff. A full-length batten is fitted to the leech of each sail. The leech of each sail may overlap the luff of the adjacent aft sail. Sheets run from each sail leech to starboard and port members of a pantograph moveably carried in an horizontal plane about at the vertical midpoint of the sails. Fore and aft movement of the pantograph members to vary the set of the sails may be linked to the movement of a rudder to provide automatic constant sailing direction relative to wind direction. The sailcraft can be a multihull type in which starboard and port hulls or pontoons are cantilevered to a central mast-supporting section for pivoting between an extended, sailing position and a retracted, transport position.

16 Claims, 12 Drawing Figures

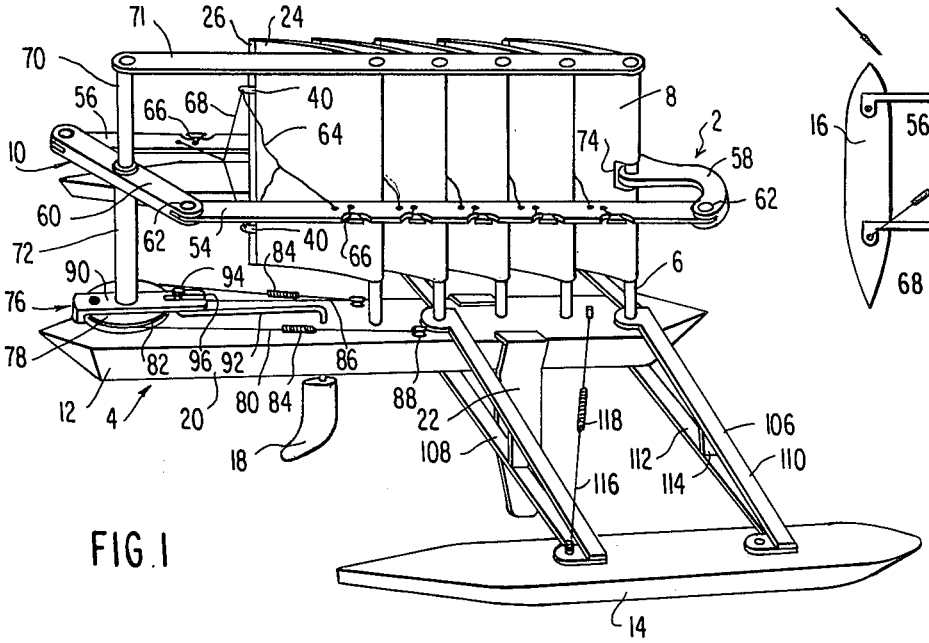
FIG. 1
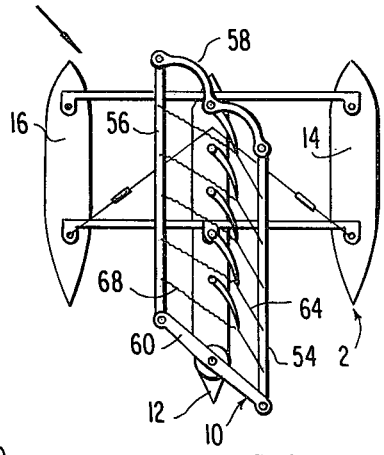
FIG. 2
FIG. 3
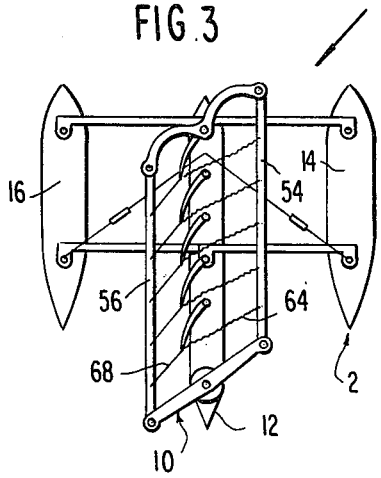
FIG. 5
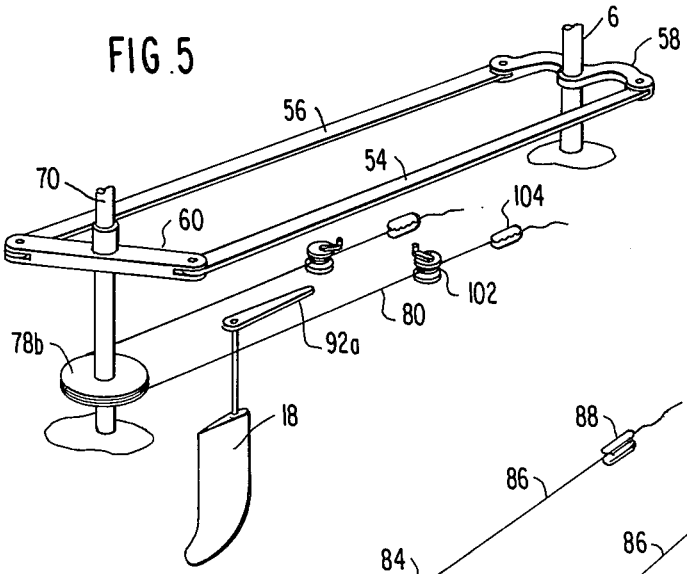
FIG. 4
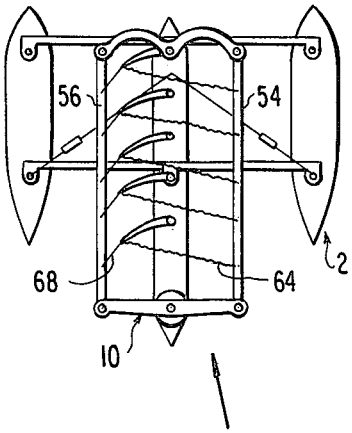
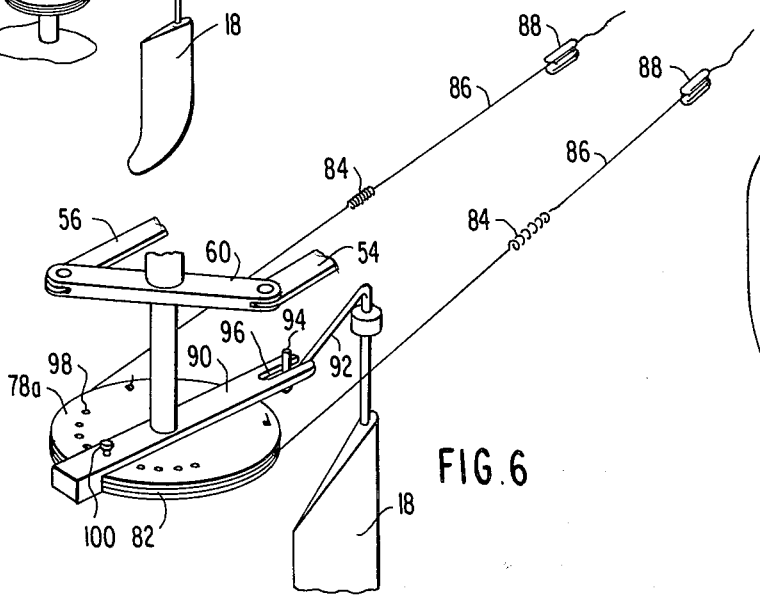
FIG. 6

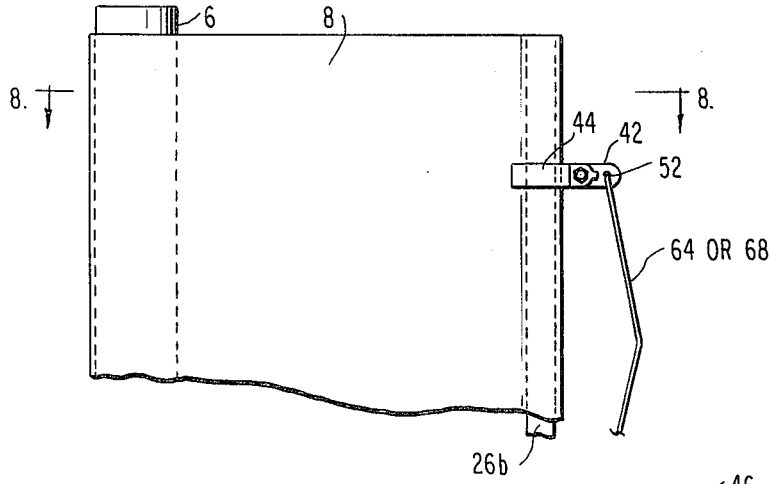
FIG. 7
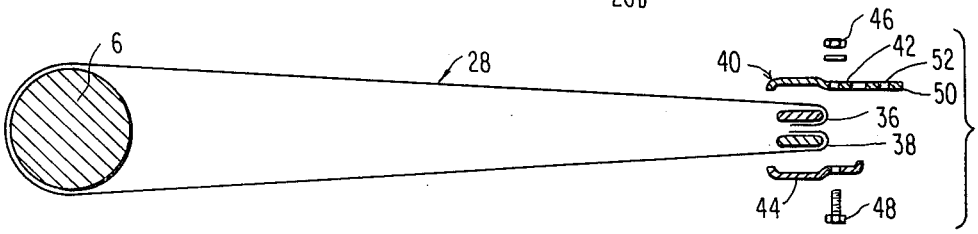
FIG. 8
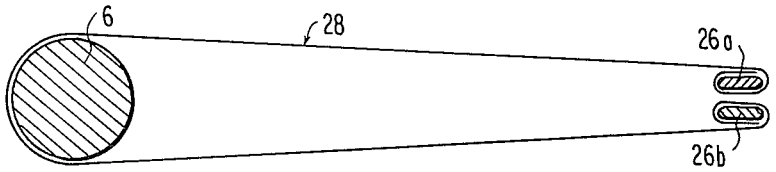
FIG. 9
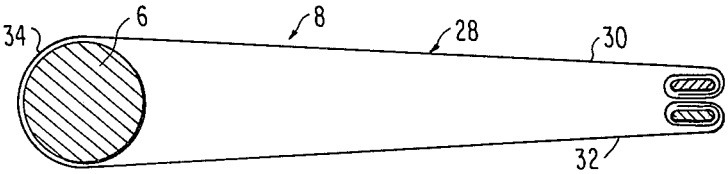
FIG. 10
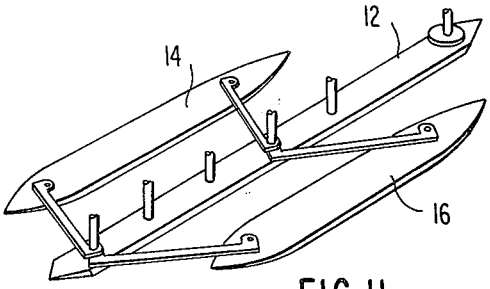
FIG. 11
FIG. 12
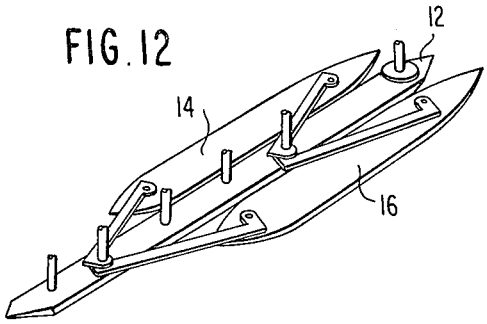

SAILCRAFT

BACKGROUND OF THE INVENTION

1. Field of the Invention

The invention relates generally to high speed sailcraft, to improvements in sailcraft design and to new methods of sail control and trimming.

More particularly, the invention concerns new forms of sailcraft, both of full scale type and models or toys, including sailboats, iceboats, and wheeled sailcraft. The invention especially relates to catamarans, trimarans and like multihulled vessels.

The invention also particularly concerns new sail structures and sail control means for sailcraft.

2. Description of the Prior Art

Sailcraft that operate on water, may be divided into two principal classes, i.e., monohulls and multihulls. This invention applies to both types, but is specially concerned with improvements in multihulls. Other forms of sailcraft are known that operate on ice or land, i.e., iceboats and wheeled sailcraft. The concepts of the invention for sailcraft construction and operation can also be applied to these classes of sailcraft.

The most common type of sail used at present on sailcraft is the jib-headed or Marconi type. Other types include lateen sails, gaff-ring sails, square-rig sails and lug sails. A lesser known and used type is rectangular shaped sails that, unlike the square rig sails which are spread on horizontal yardarms, are carried on vertical masts, e.g., see U.S. Pat. Nos. 4,116,151 and 4,280,428. The present invention concerns improvements in such type of rectangular sails.

It is also known in the art to provide sails with vertical leech battens, as opposed to the more conventional horizontal battens, to which sheets or other control lines can be bent. The sails on Chesapeake Bay log canoes are examples of such sail construction. This invention concerns improved sail systems that comprise leech battens.

There are numerous devices that automatically alter the set of a sail to compensate for the change of wind direction relative to the longitudinal axis of the sailcraft, e.g., vaned self-steering devices. Other arrangements have been developed specifically for multihulls, e.g., see U.S. Pat. No. 2,106,432. The present invention provides a new system for such automatic sail control.

Multihull vessels because of their greater beam than monohulls exhibit less tendency to heel, can be made of shallower draft for a given displacement, and usually sail faster on most points of sail. However, their wide beams present problems in berthing and in land transport or storage. Hence, because of these problems and for other reasons, multihull vessels have been designed so that their beam may be reduced or other changes effected by altering relative positions of their hulls. A number of prior art disclosures of this exist including U.S. Pat. Nos. 4,159,006; 4,172,426; 4,213,412; 4,228,750; 4,286,533 and 4,294,184. This general type of multihull vessel construction has been utilized with the present invention in a unique manner to create new forms of multihull sailcraft.

OBJECTS

A principal object of this invention is to provide new types of sailcraft capable of sailing at relatively high speeds.

Further objects include the provision of:

1. New sail structures and control means therefore.
2. New methods of sail control and trimming.
3. Sail control equipment that can automatically adjust sail trim upon change of wind direction.
4. Means of automatically steering a sailcraft in a substantially constant direction with respect to the ambient wind direction, particularly useful with model or toy sailcraft.
5. New methods for reefing or reducing sail length and new sail structures for use in carrying out such methods.
6. New forms of multihull sailcraft comprising unique means for changing relative positions of the hulls thereof.
7. Means for simultaneous changing the trim of a multiplicity of sails on a sailcraft.
8. Plural mast and sail configurations for sailcraft that will optimize the forward driving component of the sail plan while minimizing its heeling movement resulting from the wind's lateral component relative to the sailcraft.
9. New sailcraft design to mitigate wind drag and improve forward speed.
10. New designs for multihull sailcraft to permit beam reduction for land transport or storage without need for dismantling parts thereof or requiring similar time-consuming or tedious work.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

The stated objects are accomplished, in part, according to the invention by the provision of sailcraft that comprise a hull or like portion that carries a plurality of vertical masts of approximately equal height, a rectangular shaped sail carried by and flown from each mast, all the separate sails being about the same size, a straight leech in each sail that is substantially parallel to the mast carrying the sail and a full-length batten in each leech of the sail.

Multiple sails of low height and relatively short length are used to provide equivalent sail area and efficient air foils with appreciably less capsizing moment than taller conventional sail rigs.

In preferred embodiments of the invention, the sails comprise rectangular sections of fabric that are folded back on themselves and the folded luff encloses the mast on which the sail is carried. This leaves two free trailing ends on the fabric section and to each is fixed a full-length batten. The sail leech is formed by fastening these battens together by clips, clamps, or the like. The sails may be reefed or shortened by releasing the clips, rolling an equal number of turns of fabric around each batten and refastening them together with the clips. Alternatively, the sails may be furled by releasing the sheets and wrapping each sail around its battens and lashing the resulting roll to the mast on which the sail is mounted.

The sailcraft further includes a pantograph sail control unit that comprises a starboard longitudinal member, a port longitudinal member, a fore transverse member and an aft transverse member. Such pantograph members are mounted above the sailcraft hull or like portion in an horizontal plane that is perpendicular to the longitudinal axes of the masts and, advantageously, that passes through about the vertical midpoint of the sails. Each of the sails has sheets or like lines that run from the sail leech to the port and starboard members of the pantograph unit. Preferrably, such members have cleats or like elements to permit adjustment in the length of the sheets.

Additionally, the pantograph unit comprises means to move its port and starboard members fore and aft in its mounted plane thereby to control the set or trim of all sails simultaneously whether on a starboard or port tack. The action of the pantograph unit can give the unique effect of tightening the sail sheet while coincidentally moving its aft point of attachment toward the longitudinal centerline of the sailcraft. This enhances its pointing ability, i.e., its ability to sail closer into the direction of the wind.

The sailcraft may include two or more pantograph units and these would be mounted in a balanced manner relative to the vertical extension of the masts.

For sailcraft of the invention designed to sail on water, the mast supporting hull portion will have a rudder that depends from the aft portion and in certain preferred embodiments there is provided linkage interconnecting the rudder with the pantograph unit so that movement of the port and starboard members of the pantograph unit will produce a related rotation in the rudder.

In a preferred form of multihull sailcraft of the invention, there is a central hull portion to which there is cantilevered by truss members a spaced apart, parallel starboad pontoon (hull) and a spaced apart, parallel port pontoon (hull). The central hull portion may be one that extends into the water when the boat is operated, e.g., a typical trimaran, or it may be one that is retained above the water level by the outboard hulls. Advantageously, the connection of truss members to the respective hull portion and pontoons are rotatable (hinged) so that these three longitudinal parts of the sailcraft may be moved from an extended position used in sailing to a retracted position used for land transport or storage. The lower ends of masts may be used as axes upon which the truss members pivot in some preferred embodiments.

The stated objects are further accomplished according to the invention by new methods of sail trim or control which comprises providing a sailcraft with a plurality of rectangular sails bent to vertical masts, having full-length battens or other means on the leech of the sails by which the sail may be pulled away from its mast uniformly along its length while the leech remains substantially parallel to the mast and simultaneously applying equal tension to each sail leech with substantially the same longitudinal and transverse vectors continuously whether the tension is increased or decreased and whether the sails be on a port or starboard tack. Preferrably such simultaneous and continuously equal leech tension on all sails is attained by use of a pantograph control unit which also permits changing tack through adjustment of only one set of lines that control the pantograph unit position.

In such new sail control methods, the sails may overlap each other to provide air slots of varying scope depending on sail reefing and pantograph unit position.

BRIEF DESCRIPTION OF THE DRAWINGS

A more complete understanding of the new sailcraft and sailing methods of the invention may be had by reference to the accompanying drawings in which:

FIG. 1 is a perspective side view of a sailcraft of the invention with its parts positioned in a sailing configuration.

FIG. 2 is a plan view of the sailcraft of FIG. 1 on a close hauled port tack.

FIG. 3 is a plan view of the same sailcraft on a starboard tack.

FIG. 4 is a plan view of the same sailcraft running with the wind.

FIG. 5 is a detailed plan view of pantograph linkage means for sail control of a sailcraft by manual steering in accordance with the invention.

FIG. 6 is a detailed plan view of pantograph linkage means for sail control by automatic steering in accordance with the invention.

FIG. 7 is a fragmentary, lateral view of a rectangular sail constructed in accordance with this invention.

FIG. 8 is a sectional view of the sail taken on line 8—8 of FIG. 7 with the leech clip of FIG. 7 unfastened in FIG. 8.

FIG. 9 is a sectional view similar to FIG. 8 with the sail in the process of being reefed.

FIG. 10 is another sectional view similar to FIG. 8 with the sail further reefed.

FIG. 11 is a perspective view of the sailcraft of FIG. 1 with its parts in a partially retracted position.

FIG. 12 is a perspective view of the sailcraft of FIG. 11 with its parts in fully retracted position for land transport or storage.

DESCRIPTION OF THE PREFERRED EMBODIMENTS

Referring in detail to the drawings, the sailcraft 2 basically comprises a hull portion 4, a plurality of masts 6, rectangular shaped sails 8 and a pantograph unit 10.

The masts 6 are all of substantially equal height and are supported by and extend vertically upward and parallel from the hull portion 4.

The hull portion 4 can be a single hull (monohull), but preferrably the hull portion is a multihull, e.g., a catamaran, or a trimaran having a central hull 12, a starboard outerhull or pontoon 14 and a port outerhull or pontoon 16. A rudder 18 depends from the aft section 20 of hull 12 and a longitudinally adjustable center board 22 depends from hull 12 forward of the rudder 18.

The sails 8 are preferrably of the same size and shape. Each one is carried by and flown from a separate mast 6. The sails 8 have straight leechs 24 that are approximately parallel to the masts 6 and each leech 24 carries a full length batten 26. Sails 8 may be bent to the masts 6 in various ways, e.g., by the use of conventional track and slides. However, in the preferred embodiments shown in the drawings, sails 8 each comprise a rectangular section of fabric 28 that is folded back upon itself creating a starboard panel 30 and port panel 32 with the forward end 34 enclosing the mast 6 upon which the sail 8 is carried. In this form of sail, full length battens **26*a* and 26*b* are fixed to the trailing ends 36 and 38 of panels 30 and 32 respectively. Releasable clips 40 hold the ends 36 & 38 together. By removing the clips 40, the sails 8 may be reefed by winding sail fabric 28 about the battens 26*a* & 26*b* (see FIGS. 8—10) and then refastening the clips 40**.

The clips 40 may be constructed in a variety of ways. As illustrated in FIG. 8, the clip 40 may comprise a starboard member 42 and port member 44 fastened together by nut 46 and bolt 48 or equivalent fastener. An outboard end portion 50 on member 42 is provided with a hole 52 by which a sheet may be bent to the sail 8.

The pantograph unit 10 is used to set the sails 8 and can also be used to steer the sailcraft as will be described later. It comprises a starboard longitudinal member 54 and a port longitudinal member 56, a fore transverse member 58 and an aft transverse member 60. Members 58 & 60 have slotted ends to receive the ends of members 54 & 56 and the assembly of these members is held together for relative movement by pins 62 or like elements. The pantograph unit 10 is mounted above the hull 12 in a plane that is substantially perpendicular to the longitudinal axes of the masts 6 and with members 54 & 56 outboard of the sails 8.

Starboard sail sheets 64 fixed at their inboard end to clips 40 on the leechs 24 of sails 8 lead to cleat means 66 formed in or carried upon the pantograph member 54. The means 66 enables the length of sail sheet 64 existing between the sails 8 and the member 54 to be varied. Port sail sheets 68 are similarly arranged on the port side.

The mountings for the unit 10 as mentioned above comprise an aft column 70 journalling a tubular shaft 72 at the top of which the pantograph member 60 is fixed and the foremost mast 6 to which the member 58 is fixed at the proper height so the unit 10 is in the plane as aforesaid. The front sail 8 has a cut-out portion 74 to accomodate the member 58. The masts 6 are joined together at the tops with aft column by longitudinal beams 71.

The means 76 to move the pantograph unit 10 to control the set of the sails 8 comprises in the embodiment of FIG. 1 a sheave 78 fixed to the bottom end of shaft 72. A line 80 is carried in the perpherial groove 82 of sheave 78 and is joined at its free ends to springs 84 and these, in turn, are connected to line 86 that are belayed to cleats 88. A slotted crank 90 is fixed to the top of sheave 78 to turn with it. The rudder 18 is fixed to the tiller 92 having an upturned end 94 that moves in the slot 96 of crank 90 as it turns with sheave 78. Hence, in this embodiment the means 76 not only moves pantograph members 54 & 56 in the plane of unit 10, thereby effecting the set of sails 8, but also moves the rudder 18 to effect the steering of the sailcraft 2.

It is to be noted that rotation of the sheave 78 causes the rudder 18 to rotate in the opposite direction. The springs 84 acting through line 80 biases sheave 78 to return it to its position set by adjustment of lines 86 against the turning force exerted by shaft 72 and pantograph member 60 due to forces of wind on sails 8 as transmitted by tension in the sheets 64 and 68 connected to pantograph members 54 & 56.

In the embodiment shown in FIG. 6, the sheave **78*a* has a series of holes 98 therein into any of which the pin 100 may be inserted so that the lever linkage between the rudder 18 and sheave 78*a* may be altered. This enables fine tuning of the self-steering ability of the sailcraft 2 provided by the means 76**.

In the embodiment shown in FIG. 5, the sailcraft is not self-steering. Thus, the rudder 18 is equipped with a conventional tiller **92*a* and sheave 78*b* turns without effecting the rudder position. Winches 102 are provided to assist in moving line 80 for position control of unit 10 and jamb cleats 104 are used to belay line 80** in the controlled position.

In FIGS. 5 & 6, representation of some of the masts 6 has been omitted for clarity of the illustration.

The pontoons 14 & 16 are cantilevered on the hull 12 by truss members 106 & 108. The truss members may be constructed in various ways. As shown in FIG. 1, they comprise upper web 110, lower web 112 and cross web 114. They are attached to the pontoons 14 & 16 and to the hull 12 so that the pontoons may be moved from an extended position as shown in FIG. 1 to a retracted position (see FIGS. 11 & 12) used for storage or for trailer land transport of the sailcraft. The pontoons may be held in the extended position during sailing by lines 116 that may include a spring 118 to act as a shock absorber.

FIG. 2 to 4 illustrate how the sailcraft 2 performs on various points of sail. FIG. 2 shows it beating to windward on port tack with the pantograph unit 10 in canted position with member 54 moved aft and member 56 moved forward while the starboard sheets 64 are taut and the port sheets 68 are slack.

FIG. 3 shows the sailcraft beating to windward on starboard tack with the pantograph unit 10 in canted position with member 56 moved aft and member 54 moved forward while the port sheets 68 are taut and the starboard sheets 64 are slack.

FIG. 4 shows the sailcraft on a broad reach or running on starboard tack with the unit 10 in a neutral position while port sheets 68 are taut and starboard sheets 64 are slack. As shown, the leech of each sail may overlap the luff of the sail that is immediately aft. In contrast, conventional mainsails cannot overlap forming air slots because the booms on such rigs cannot swing across when tacking if there were such overlapping.

The embodiments of the invention in which an exclusive property or privilege is claimed are defined as follows:

1. A sailcraft comprising:

a hull portion, a plurality of masts of substantially equal height supported by and extending vertically upward and parallel from said hull portion, a rectangular shaped sail carried by and flown from each of said masts, all said sails being of about the same size, a straight leech in each of said sails that is approximately parallel to the mast on which the sail is carried, a full-length batten in each of said sail leechs, at least one pantograph comprising a starboard longitudinal member, a port longitudinal member, a fore transverse member and an aft transverse member, said pantograph being mounted above said hull portion in a plane that is substantially perpendicular to the longitudinal axes of the masts and with said longitudinal members thereof outboard of said sails, each of said sails having sheets running from its leech to said port and starboard longitudinal members, and means to move said longitudinal members fore and aft in said plane to control the trim of said sails.

2. The sailcraft of claim 1 wherein said means comprises a vertical shaft to which said aft transverse member is fixed adjacent the top end thereof and an element to rotate said shaft.

3. The sailcraft of claim 2 which comprises a rudder that depends from the aft section of said hull portion and wherein said element includes a sheave fixed to said shaft adjacent its bottom end thereof, and adjustable lever linkage interconnecting said rudder with said sheave so that rotation of said sheave produces a rotation of said rudder in the opposite direction.

4. The sailcraft of claim 3 wherein said sheave is biased with an adjustable and predetermined spring force to return it to a balanced position against a turning force exerted by the shaft and transverse pantograph member due to forces of the wind in the sails as transmitted by tension in the sheets to the pantograph.

5. The sailcraft of claim 3 wherein a longitudinally adjustable center board depends from said hull portion forward of said rudder.

6. The sailcraft of claim 1 wherein said sails comprise a rectangular section of fabric that is folded back upon itself, the forward end thereof encloses the mast upon which the sail is carried and a full-length batten is fixed to each trailing end of said fabric section.

7. The sailcraft of claim 6 wherein releaseable clips hold said trailing ends of each sail together and by removing said clips said sails may be reefed by winding sail fabric about said battens and then refastening said clips.

8. The sailcraft of claim 7 wherein said sheets are fastened at the outboard ends to said clips.

9. The sailcraft of claim 1 which comprises a starboard pontoon and a port pontoon, said pontoons being cantilevered spaced apart from and parallel to said hull portion by truss members.

10. The sailcraft of claim 9 wherein said truss members are rotatably connected to said hull portion and said pontoons whereby the pontoons may be moved from an extended position used in sailing of the sailcraft to a retracted position used in trailer land transport of the sailcraft.

11. The sailcraft of claim 3 wherein said adjustable lever linkage alters the position of the tiller with respect to said sheeve.

12. The method for handling fore and aft sails on a sailcraft which comprises the steps of:

providing a sailcraft with a plurality of fore and aft rectangular sails each comprising a luff and a leech, said sails being bent at their luffs to separate vertical masts, providing each leech of said sails with leech means including sail sheets by which the sail may be pulled away from its mast uniformly along its fore and aft length while its leech remains substantially parallel to its mast, simultaneously applying substantially equal tension to each sail leech via said sail sheets with substantially the same longitudinal and transverse vectors continuously whether such tension is increased or decreased and whether the sails be on a port or starboard tack, and simultaneously and equally changing said sail leech tension on all sails from time to time as the sailcraft is driven forward by the force of wind upon the sails.

13. The method of claim 12 wherein said leech means comprise full length battens fixed to the sail leechs.

14. The method of claim 12 including the step of simultaneously moving each sail sheet at its aft end tension point transversely to the longitudinal centerline of the sailcraft in concert with the simultaneous tensioning of said sail sheets.

15. The method for handling fore and aft sails on a sailcraft thereon the trim of said sails is controlled by sail sheets attached to the leechs thereof which comprises the steps of:

simultaneously moving said sail sheet of each sail at its aft end tension point transversely to the longitudinal centerline of said sailcraft, and simultaneously tensioning said sail sheet of each sail by means of a pantograph unit.

16. A method of automatically controlling the direction of movement of a sailcraft, equipped with a rudder, a plurality of fore and aft sails and a pantograph unit used to simultaneously trim the sails, to compensate for changes in wind direction relative to hull axis movement which comprises utilizing the relative motion of said sail trimming pantograph unit to impart through connecting means a course corrective torque to said rudder of said sailcraft.

* * * * *